US011435139B2

(12) United States Patent
Davidian

(10) Patent No.: US 11,435,139 B2
(45) Date of Patent: Sep. 6, 2022

(54) METHOD AND APPARATUS FOR SEPARATING AIR BY CRYOGENIC DISTILLATION

(71) Applicant: L'Air Liquide, Societe Anonyme pour l'Etude et l'Exploitation des Procedes Georges Claude, Paris (FR)

(72) Inventor: Benoit Davidian, Champigny sur Marne (FR)

(73) Assignee: L'Air Liquide, Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 237 days.

(21) Appl. No.: 16/768,067

(22) PCT Filed: Nov. 8, 2018

(86) PCT No.: PCT/FR2018/052776
§ 371 (c)(1),
(2) Date: May 28, 2020

(87) PCT Pub. No.: WO2019/106250
PCT Pub. Date: Jun. 6, 2019

(65) Prior Publication Data

US 2020/0370825 A1 Nov. 26, 2020

(30) Foreign Application Priority Data

Nov. 29, 2017 (FR) ..... 1761346

(51) Int. Cl.
*F25J 3/04* (2006.01)

(52) U.S. Cl.
CPC ..... *F25J 3/044* (2013.01); *F25J 3/048* (2013.01); *F25J 3/0423* (2013.01); *F25J 3/0466* (2013.01);
(Continued)

(58) Field of Classification Search
CPC ..... F25J 3/04; F25J 3/04406; F25J 3/04412; F25J 3/04418; F25J 3/04424;
(Continued)

(56) References Cited

U.S. PATENT DOCUMENTS 2,934,907 A * 5/1960 Scofield ..... F25J 3/04412 62/656
4,057,407 A * 11/1977 Bigi ..... F25J 3/04727 62/648
(Continued)

FOREIGN PATENT DOCUMENTS

FR 2 705 141 11/1994
FR 3 052 242 12/2017
(Continued)

OTHER PUBLICATIONS

International Search Report and Written Report for PCT/FR2018/052776, dated May 16, 2019.
(Continued)

*Primary Examiner* — Brian M King
*Assistant Examiner* — Erik Mendoza-Wilkenfel
(74) *Attorney, Agent, or Firm* — Justin K. Murray

(57) ABSTRACT

The invention relates to a method for separating air by cryogenic distillation in a column system, comprising a first column operating at a first pressure and a second column operating at a second pressure, in which an argon-enriched flow is sent from an intermediate point of the first column to the tank of the second column and an argon-rich flow is drawn off at the top of the second column, wherein a nitrogen-enriched flow of the first column is compressed in
(Continued)

a compressor, the compressed flow is sent to a head condenser of the second column after an expansion step and the vaporized flow is expanded in the condenser in a turbine where it at least partially liquefies.

15 Claims, 2 Drawing Sheets

(52) U.S. Cl.
CPC ..... *F25J 3/04224* (2013.01); *F25J 3/04309* (2013.01); *F25J 3/04357* (2013.01); *F25J 3/04393* (2013.01); *F25J 3/04939* (2013.01); *F25J 2200/40* (2013.01); *F25J 2200/76* (2013.01); *F25J 2200/78* (2013.01); *F25J 2235/42* (2013.01); *F25J 2245/58* (2013.01)

(58) Field of Classification Search
CPC .. F25J 3/04642; F25J 3/04648; F25J 3/04654; F25J 3/0466; F25J 3/04666; F25J 3/04672; F25J 3/04678; F25J 3/0469; F25J 3/04696; F25J 3/04721; F25J 3/04727; F25J 3/04739; F25J 2200/40; F25J 2200/50; F25J 2200/52; F25J 2200/54; F25J 2200/78; F25J 2250/00; F25J 2250/02; F25J 2250/04; F25J 2250/10; F25J 2250/20; F25J 2250/30; F25J 2250/40; F25J 2250/42; F25J 2250/50; F25J 2250/52; F25J 2250/58
See application file for complete search history.

(56) References Cited

U.S. PATENT DOCUMENTS

| | | | | |
|---|---|---|---|---|
| 4,756,731 | A * | 7/1988 | Erickson | F25J 3/04393 62/651 |
| 4,783,208 | A * | 11/1988 | Rathbone | F25J 3/04672 62/651 |
| 4,818,262 | A | 4/1989 | Brugerolle | |
| 4,883,516 | A * | 11/1989 | Layland | F25J 3/04393 62/651 |
| 2001/0052243 | A1* | 12/2001 | Davidian | F25J 3/04387 62/643 |
| 2008/0029381 | A1* | 2/2008 | Dubettier | F25J 3/0252 203/41 |

FOREIGN PATENT DOCUMENTS

| | | |
|---|---|---|
| FR | 3 052 243 | 12/2017 |
| FR | 3 052 244 | 12/2017 |
| FR | 3 059 087 | 5/2018 |
| GB | 1 258 568 | 12/1971 |

OTHER PUBLICATIONS

Agrawal, R., et al., "Heat Pumps for Thermally Linked Distillation Columns: An Exercise for Argon Production from Air," Industrial & Engineering Chemistry Research, vol. 33, No. 11, Jan. 1, 1994, pp. 2717-2730.

* cited by examiner

METHOD AND APPARATUS FOR SEPARATING AIR BY CRYOGENIC DISTILLATION

CROSS REFERENCE TO RELATED APPLICATIONS

This application is a § 371 of International PCT Application PCT/FR2018/052776, filed Nov. 8, 2018, which claims the benefit of FR1761346, filed Nov. 29, 2017, both of which are herein incorporated by reference in their entireties.

FIELD OF THE INVENTION

The present invention relates to a method and to an apparatus for separating air by cryogenic distillation.

BACKGROUND OF THE INVENTION

In an apparatus for separating air using low-pressure single-column distillation to separate the air, it is sought to produce argon without having rich liquid from a medium-pressure column to operate the condenser of the argon column.

The invention consists in using a portion of a nitrogen cycle which provides the reboiling and the reflux for the single column operating at low pressure to operate the condenser of the argon column.

Without overcomplicating the scheme of the method, this additionally makes it possible to benefit from a high degree of operational flexibility: in the event of a rush of nitrogen into the argon column, it is possible to ensure condensation continues at the top of the argon column, and therefore to maintain oxygen production without the risk of the argon column, and then the low-pressure column, stopping.

In addition, the proposed scheme is better in energy terms than those of the prior art, in particular for high argon yields.

A person skilled in the art could design a single-column apparatus operating at low pressure (or LP) with a nitrogen cycle and with draw-off of a rich pseudo-liquid at an intermediate point of the LP column to feed the condenser of the argon column. This liquid could be taken between the top of the column and the draw-off of gas enriched in argon sent to the argon column. The liquid would be pumped to arrive at the condenser of the argon column, where it would be vaporized and would then be sent to the LP column at a level below the liquid draw-off point.

It is known for an LP single-column apparatus on a nitrogen cycle to have the condenser of the argon column which operates on an argon cycle, such as described in FIG. 3*c* of the article by R. Agrawal "Heat pumps for thermally linked distillation columns: an exercise for argon production from air", Ind Eng. Chem. Res. 1994, 33, pp. 2717-2730.

Also known, from GB1258568, is the practice of using a nitrogen cycle to reboil the LP column, the liquefied nitrogen being used as a reflux for the LP column and to cool the condenser of the argon column. The top condenser of the argon column operates at the same pressure as the LP column. However, the argon column operates at a higher pressure than the low-pressure column, as evinced by the valve for the gas between the two columns and the pump for the liquid between the two columns.

SUMMARY OF THE INVENTION

According to one subject of the invention, what is provided is a method for separating air by cryogenic distillation in a column system comprising a first column operating at a first pressure and a second column operating at a second pressure, the first pressure being substantially equal to the second pressure, wherein:

i) compressed, purified and cooled air is sent to an intermediate point of the first column, a liquid enriched in oxygen is drawn off from the bottom of the first column and/or a gas enriched in oxygen is drawn off from the first column and a flow enriched in nitrogen is drawn off from the top of the first column;

ii) a flow enriched in argon is sent from an intermediate point of the first column to the bottom of the second column and a flow rich in argon is drawn off from the top of the second column;

iii) the flow enriched in nitrogen is compressed in a compressor and the compressed flow is used to heat a bottom reboiler of the first column, producing an at least partially condensed flow enriched in nitrogen;

iv) the at least partially condensed flow enriched in nitrogen is divided into first and second portions, the first portion is sent to the top of the first column after an expansion step and the second portion is sent to a top condenser of the second column after an expansion step in which the second portion is at least partially vaporized to form an auxiliary flow, characterized in that v) the auxiliary flow is expanded in a turbine where it is at least partially liquefied and the at least partially liquefied flow is sent to the top of the first column.

According to other optional aspects:

- the auxiliary flow is partially liquefied at the outlet of a wheel of the turbine, or even in the wheel of the turbine;
- at the outlet of the wheel or in same, an expanded auxiliary flow containing between 0.5% and 10%, preferably between 2% and 5%, liquid is obtained;
- the auxiliary flow is directly expanded in the turbine, without prior heating;
- the flow enriched in nitrogen is heated in a heat exchanger upstream of the compressor, the compressed flow enriched in nitrogen being cooled in the heat exchanger and subsequently sent at least in part to the bottom reboiler;
- a portion of the compressed flow enriched in nitrogen is expanded in a second turbine and returned to the heat exchanger;
- the inlet temperature of the turbine and/or of the second turbine and/or of the compressor is a cryogenic temperature;
- a liquid flow rich in argon is sent from the top of the second column to the top of the first column;
- in operation, no purge flow is drawn off from the condenser of the second column;
- after the expansion steps, the first and second portions of the at least partially condensed flow enriched in nitrogen are at different pressures and/or temperatures, the second portion preferably being at a higher pressure than the first portion; and/or
- the first and second columns operate at the same pressure.

According to another aspect of the invention, what is provided is an apparatus for separating air by cryogenic distillation in a column system comprising a first column operating at a first pressure and having a bottom reboiler and a second column operating at a second pressure having a top condenser, the first pressure being substantially equal to the second pressure, a compressor, a turbine, a pipe for sending compressed, purified and cooled air to an intermediate point of the first column, a pipe for drawing off a liquid enriched in oxygen from the bottom of the first column and/or a gas enriched in oxygen from the first column and a pipe for drawing off a flow enriched in nitrogen from the top of the first column and for sending it to the compressor, a pipe for sending a flow enriched in argon from an intermediate point of the first column to the bottom of the second column, a pipe for drawing off a flow rich in argon from the top of the second column, a pipe for sending the flow enriched in nitrogen compressed in the compressor to the bottom reboiler of the first column in order to produce an at least partially condensed flow enriched in nitrogen, means for dividing the at least partially condensed flow enriched in nitrogen into first and second portions, means for sending the first portion to the top of the first column after an expansion step, means for sending the second portion to the top condenser of the second column after an expansion step in which the second portion is at least partially vaporized to form an auxiliary flow, means for sending the auxiliary flow to the turbine where it is at least partially liquefied and means for sending the at least partially liquefied flow to the top of the first column, these means potentially comprising a phase separator for separating the liquid and gas formed in order for them then to be sent separately to the first column.

According to other optional aspects of the invention:

- the apparatus does not comprise means for heating the auxiliary flow upstream of the turbine;
- the apparatus comprises a heat exchanger and means for sending the flow enriched in nitrogen to be heated in the heat exchanger upstream of the compressor;
- the apparatus comprises means for sending the compressed flow enriched in nitrogen from the compressor to the heat exchanger to be cooled;
- the apparatus comprises a second turbine and means for sending thereto;
- a portion of the compressed flow enriched in nitrogen;
- the apparatus comprises means for sending a liquid flow rich in argon from the top of the second column to the top of the first column;
- no air turbine is present.

In certain embodiments, the invention consists in using a portion of the nitrogen cycle which provides the reboiling and the reflux for the LP single column to operate the condenser of the argon column.

The cycle nitrogen can be condensed in the vaporizer of the LP column. A portion of the nitrogen can be completely, preferably partially, subcooled and sent into the condenser of the argon column.

In the condenser, it is vaporized at an intermediate pressure between the pressure of the nitrogen cycle and the pressure of the LP column, the vaporization thereof making it possible to condense the upflowing vapor in the argon column to provide the reflux for the argon column.

The nitrogen vaporized at an intermediate pressure is then expanded in a turbine toward the top of the LP column. Since this turbine is very cold, what is obtained at the outlet is a partially two-phase mixture, the liquid portion also contributing to the reflux for the LP column. The cold produced by the turbine allows all or some of the cooling power to be applied to outputting the argon produced directly in liquid form, to be sent to storage for example.

In the event of a rush of nitrogen into the argon column, it will be possible to continue to provide a reflux in the argon column by decreasing the intermediate pressure so as to lower the temperature of the vaporized nitrogen, which makes it possible to continue condensing the upflowing vapor which is loaded with nitrogen and hence has become colder. Argon draw-off is stopped because it does not meet the nitrogen specification. The cooling power of the turbine is significantly decreased because the intermediate pressure has been decreased, but that does not matter because liquid argon is no longer being produced.

Keeping the argon column in operation avoids disrupting, or even stopping the LP column (through the liquid held in the argon column being sent in quantity to the LP column), which allows the reliability of oxygen production to be increased, regardless of disruptions for the argon column.

The nitrogen rush may be evacuated for example by purging at the condenser of the argon column or the top of the argon column, while keeping the argon column operating with respect to the difficult argon/oxygen separation.

Once the nitrogen rush has been evacuated, there is an immediate return to argon production with good nitrogen and oxygen specifications, unlike a more conventional apparatus in which a nitrogen rush will stop the argon column, requiring the stock of liquid in the argon column to be entirely renewed when it is restarted.

This high tolerance makes it possible to have an operation when running that gets very close to the maximum achievable argon yield for the process operation in question, without taking an operational margin to avoid unwanted stoppages due in particular to nitrogen rushes.

Similarly, it makes it possible, by minimizing operational risks, to facilitate the omission of the denitrogenation column for purifying the argon produced by the argon column of nitrogen, by adding a few theoretical plates directly above the argon tap in the LP column, in order to substantially decrease the nitrogen content before entering the argon column.

It is needless, in operation, to purge the bath of the condenser of the argon column, since there is no liquid rich in oxygen and potentially in air secondary impurities. Purging may be of use only when stopped, for example to empty the bath of cryogenic liquid.

BRIEF DESCRIPTION OF THE DRAWINGS

Further features, advantages and possible applications of the invention are apparent from the following description of working and numerical examples and from the drawings. All described and/or depicted features on their own or in any desired combination form the subject matter of the invention, irrespective of the way in which they are combined in the claims the way in which said claims refer back to one another.

DETAILED DESCRIPTION OF THE INVENTION

The invention will be described in greater detail with reference to the figures.

Figure 1:
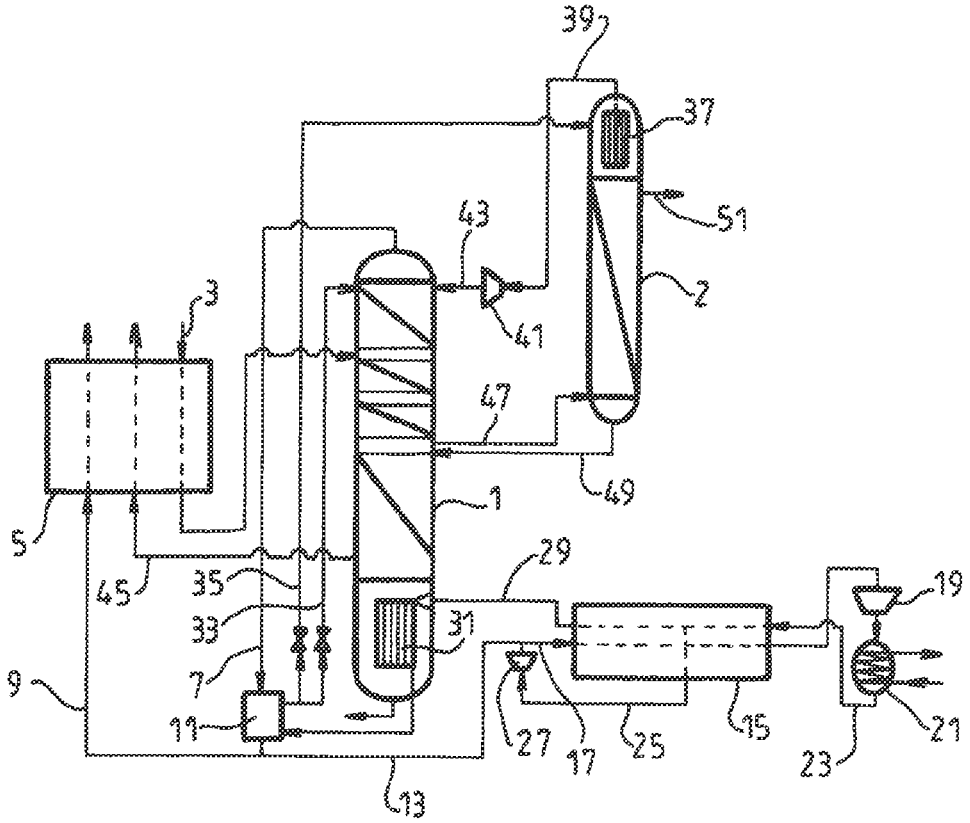
FIG. 1 provides a first embodiment of the present invention.

FIG. 1 shows an apparatus for separating air using a single column 1 for producing oxygen and nitrogen and an argon column 2.

The column 1 operates between 1.013 bara and 2 bara, for example at 1.3 bara.

The argon column 2 operates at between 1.013 bara and 2 bara, for example at 1.3 bara.

In this example, both columns operate at the same pressure.

Air that has been compressed and purified of water and of carbon dioxide 3 is cooled in a heat exchanger 5 and sent to an intermediate point of a separation column 1. The air is separated by distillation to produce liquid enriched in oxygen at the bottom of the column and nitrogen gas 7 at the top of the column. At an intermediate level of the column and below the air inlet, a flow 47 enriched in argon is withdrawn and sent to an argon column 2. Liquid argon or argon gas 51 is produced at the top of the column 2 and the bottom liquid 49 is sent to the column 1 at the draw-off level of the column 1. Neither the liquid 49 nor the gas 47 are pressurized or expanded between the two columns (beyond pressure drops and hydrostatic heads).

The apparatus is kept cold and carries out distillation by virtue of a nitrogen cycle. The nitrogen taken from the top of the column 1 is used to cool a heat exchanger 11 and is then divided into two, one portion 9 being heated in the heat exchanger 5 and one portion 13 being used to produce cold and to supply the energy for distillation. The nitrogen 13 is heated in a heat exchanger 15, compressed in a compressor 19, cooled in the cooler 21 to form the flow 23 and then returned to the exchanger 15. In the exchanger 15, the flow 23 is divided into two. A portion 29 is cooled as far as the cold end of the exchanger 15 and is then used to heat the bottom reboiler 31 of the column 1. The rest of the nitrogen 25 at an intermediate temperature from the exchanger 15 is expanded in a turbine 27 and rejoins the nitrogen 13 to return to the exchanger 15.

After having been used to heat the reboiler 31, the nitrogen 29 which has been condensed is cooled in the subcooler 11 and then divided into two. The nitrogen 29 may be divided into two before the subcooler, allowing the two portions to be subcooled differently.

One portion 33 is expanded in a valve and then sent as a reflux liquid to the top of the column 1. The other portion 35 is sent, at a pressure higher than that of column 1, to the top condenser 37 of the column 2 where it is at least partially vaporized. The nitrogen 39 thus formed is expanded in the turbine 41 and the expanded flow 43 feeds the top of the column 1, to potentially passing through a separating vessel and sending the liquid, itself potentially pumped, and the gas through two separate pipes.

The portion 35 of the nitrogen from the subcooler, which is sent to the condenser 37 of the argon column 2, is very cold, which creates a risk of crystallization. To prevent this problem, it is possible:

- to limit the subcooling of the portion 35 in the subcooler 11 with respect to the portion 33;
- to mix the portion 35 directly in the bath of the condenser 37 which is relatively warmer with respect to the risk of crystallization;
- to add an intermediate condenser in the argon column 2 (in its bottom portion, which stays relatively warm with respect to the risk of crystallization) to warm the subcooled liquid 35.

The nitrogen 43 expanded in the turbine 41 is partially liquefied at the outlet of the turbine wheel, or even in the wheel, the prevailing pressure and temperature conditions at the outlet of the wheel being such that, for example, half of the isentropic expansion has taken place. The liquid content in the wheel or at the outlet of same is then between 0.5% and 10%, preferably between 2% and 5%.

If it is desired to limit the liquid content to prevent mechanical damage to the turbine, it is possible to envisage heating the nitrogen 39 before expansion, for example in the subcooler 11. The rest of the expansion takes place in the volute of the turbine where at least some of the rest of the gas continues to be cooled and liquefied. The liquid portion thus formed thus contributes to the reflux for the LP column 1.

There is also the possibility of providing a pipe for liquid argon to the liquid nitrogen which goes to the top of the column 1, in the case of argon production being lower than the production at optimum argon yield, to benefit from an additional liquid reflux at the top of the LP column and therefore gain in energy efficiency. This pipe may go directly to the top of the LP column or be connected to a separating vessel at the outlet of the turbine.

The architecture of the apparatus may be a conventional architecture, namely one using one-piece columns of circular cross section, fitted with structured packings or plates.

However, it is also possible to use the novel architecture from FR3052242, FR3052243, FR3052244 or FR3059087. According to this architecture, the column is replaced with a stack of modules of square or rectangular cross section, each module being insulated and containing an element allowing material and heat exchange, such as packings. Separation takes place at low temperature by distillation, the liquids being distilled downflowing from one module to another and the gases upflowing from one module to another. In this way, the fluid to be separated is introduced into one module and a fluid enriched in a component of the fluid exits from another module of the same stack.

An argon option may be defined which consists of inserting a module at an intermediate position of the LP column, at the level of the argon bulge and the cold box, without having to modify the rest of the equipment. The possible lengthening of the LP column is used to advantage to add theoretical plates above the draw-off of the argon mixture in order to substantially decrease the nitrogen content at the argon bulge and therefore to omit the denitrogenation column, which simplifies the implementation of the argon option.

In the basic version, the liquid nitrogen condensed in the vaporizer, then subcooled, is expanded in a valve and then sent through a pipe in two-phase form to the top of the LP column.

In the version with argon option, it is partially expanded in the same valve and sent through the same pipe to the inserted module where one portion is partially expanded, and then sent to the condenser of the argon column, and the other portion is completely expanded and sent to the top of the LP column through the same pipe as in the basic version.

The partially expanded portion is vaporized, and then turbined:

- the gas portion is returned through the inserted module to the same pipe/duct for nitrogen gas from the top of the LP column in the basic case, to go to the single subcooler;
- the liquid portion is:
  - either pumped to be remixed with the completely expanded liquid and sent to the top of the LP column (the pump is primarily for overcoming hydrostatic head);
  - or vaporized by adding an intermediate condenser in the argon column (in its bottom portion), or by drawing off a gas from the bottom portion of the argon column in order to condense it.

The inserted module also comprises piping/duct extensions for connecting the piping/duct extensions which are placed along the LP column at the level of the argon bulge.

In this configuration of the invention, the nitrogen cycle remains unchanged between the option without argon and the option with argon, with oversizing of the equipment (in particular nitrogen cycle compressor) being limited to 10%, or even 5%, or even without any oversizing. It is therefore easy to standardize and/or to modularize it to satisfy both options.

The ad hoc addition of the turbine to the argon condenser makes it possible to provide the necessary cooling power to liquefy argon, without affecting the rest of the cold balance of the apparatus.

Figure 2:
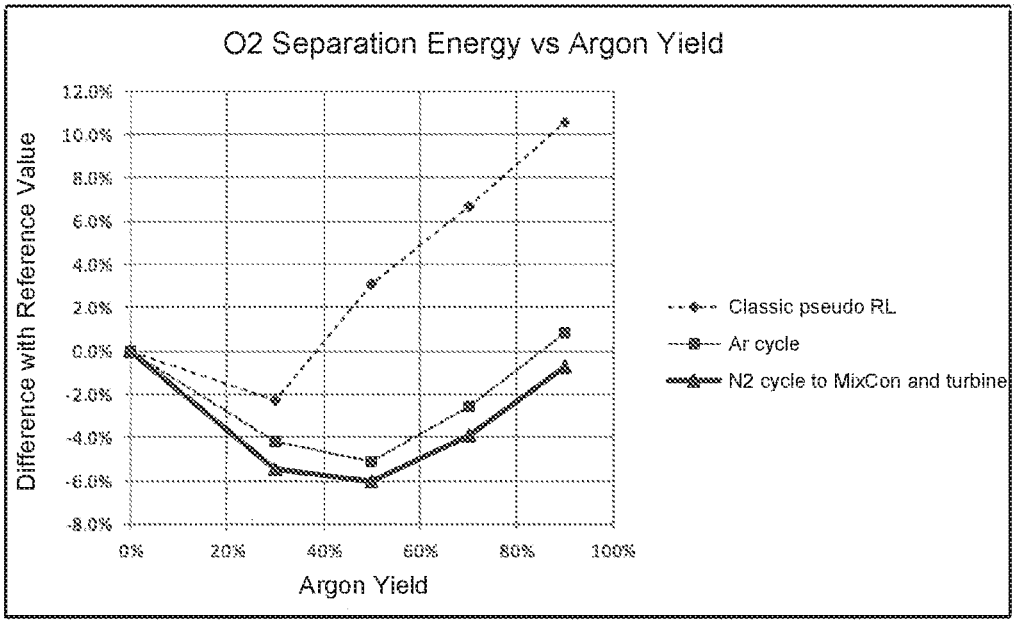
FIG. 2 provides a graphical representation of energy of oxygen separation with the argon yield.

In energy terms, the invention rates particularly well in comparison with the prior art, in particular at high argon yield as illustrated in FIG. 2, which compares the energy of oxygen separation with the argon yield.

The gain is increased by the lack of need to take margins with respect to the operation of the separation apparatus.

Potentially, an external nitrogen cycle is used to partly heat the bottom reboiler of the low-pressure column, the rest of the heating being provided by the gas from the top of the MP column.

Those of ordinary skill in the art will recognize that identical pressures are difficult, if not impossible, to maintain during operation. As such, substantially equal in pressure is meant to encompass pressures that would be recognized in the industry as being the same but for naturally occurring variances and/or internal pressure drops. In certain embodiments, there can be an absence of pressure modifying means disposed between the two columns, such that the pressure of fluids flowing between the two columns is not intentionally increased or decreased by compressors, expansion valves, turbines, or the like.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

The invention claimed is:

1. A method for separating air by cryogenic distillation in a column system comprising a first column operating at a first pressure and a second column operating at a second pressure, the first pressure being substantially equal to the second pressure, wherein:

(a) sending compressed, purified and cooled air to an intermediate point of the first column, drawing off a liquid enriched in oxygen from a bottom of the first column and/or drawing off a gas enriched in oxygen from the first column and drawing off a flow enriched in nitrogen from a top of the first column;

(b) sending a flow enriched in argon from an intermediate point of the first column to a bottom of the second column and drawing off a flow rich in argon from a top of the second column;

(c) compressing the flow enriched in nitrogen in a compressor and using the compressed flow to heat a bottom reboiler of the first column, producing an at least partially condensed flow enriched in nitrogen;

(d) dividing the at least partially condensed flow enriched in nitrogen into first and second portions, sending the first portion to the top of the first column after an expansion step and sending the second portion to a top condenser of the second column after an expansion step in which the second portion is at least partially vaporized to form an auxiliary flow; and (e) expanding the auxiliary flow in a turbine wherein the auxiliary flow is at least partially liquefied and then sent to the top of the first column.

2. The method as claimed in claim 1, wherein the auxiliary flow is partially liquefied at the outlet of a wheel of the turbine, or even in the wheel of the turbine, for example in order to obtain, at the outlet of the wheel or in same, an expanded auxiliary flow containing between 0.5% and 10% liquid.

3. The method as claimed in claim 1, wherein the auxiliary flow is directly expanded in the turbine, without prior heating.

4. The method as claimed in claim 1, wherein the flow enriched in nitrogen is heated in a heat exchanger upstream of the compressor, the compressed flow enriched in nitrogen being cooled in the heat exchanger and subsequently sent at least in part to the bottom reboiler.

5. The method as claimed in claim 4, wherein a portion of the compressed flow enriched in nitrogen is expanded in a second turbine and returned to the heat exchanger.

6. The method as claimed in claim 1, wherein the inlet temperature of the turbine and/or of the second turbine and/or of the compressor is a cryogenic temperature.

7. The method as claimed in claim 1, wherein a liquid flow rich in argon is sent from the top of the second column to the top of the first column.

8. The method as claimed in claim 1, wherein, in operation, no purge flow is drawn off from the condenser of the second column.

9. The method as claimed in claim 1, wherein, after the expansion steps, the first and second portions of the at least partially condensed flow enriched in nitrogen are at different pressures and/or temperatures, the second portion preferably being at a higher pressure than the first portion.

10. An apparatus for separating air by cryogenic distillation in a column system, the apparatus comprising:

a first column operating at a first pressure and having a bottom reboiler and a second column operating at a second pressure having a top condenser, the first pressure being substantially equal to the second pressure;

a compressor;

a turbine;

a first pipe configured to send air, which has been compressed, purified and cooled, to an intermediate point of the first column;

a second pipe configured to withdraw a liquid enriched in oxygen from a bottom of the first column and/or a gas enriched in oxygen from the first column;

a third pipe configured to withdraw a flow enriched in nitrogen from a top of the first column and then send said flow enriched in nitrogen to the compressor to form a compressed flow enriched in nitrogen;

a fourth pipe configured to send a flow enriched in argon from an intermediate point of the first column to a bottom of the second column;

a fifth pipe configured to withdraw a flow rich in argon from a top of the second column;

a sixth pipe configured to send the flow enriched in nitrogen and compressed in the compressor to the bottom reboiler of the first column in order to produce an at least partially condensed flow enriched in nitrogen;

a seventh pipe configured to send a first portion of the at least partially condensed flow enriched in nitrogen to the top of the first column after being expanded in an expansion step;

an eighth pipe configured to send a second portion of the at least partially condensed flow enriched in nitrogen to the top condenser of the second column after being expanded in an expansion step in which the second portion is at least partially vaporized to form an auxillary flow;

wherein the turbine is in fluid communication with the top condenser of the second column such that the turbine is configured to receive the auxillary flow from the second column and expand the auxillary flower to form an at least partially liquefied flow; and a ninth pipe configured to send the at least partially liquefied flow, or stream derived from the at least partially liquefied flow, to the top of the first column.

11. The method as claimed in claim 10, comprising a heat exchanger upstream of the compressor, wherein the heat exchanger is configured to heat the flow enriched in nitrogen and cool the compressed flow enriched in nitrogen.

12. The method as claimed in claim 10, comprising a second turbine that is in fluid communication with the heat exchanger such that the second turbine is configured to receive a portion of the compressed flow enriched in nitrogen.

13. The method as claimed in claim 10 wherein the top of the second column is in fluid communication with the top of the first column, such that a liquid flow rich in argon is sent from the top of the second column to the top of the first column.

14. The method as claimed in claim 10, comprising an absence of an air turbine.

15. The method as claimed in claim 10, further comprising a phase separator located downstream of the turbine, wherein the phase separator is configured to separate the at least partially liquefied flow into a liquid and a gas that are then sent separately to the first column.

* * * * *